United States Patent [19]

Brambilla

[11] Patent Number: 4,652,844

[45] Date of Patent: Mar. 24, 1987

[54] DUAL MODE FILTERS

[75] Inventor: Enrico Brambilla, Usmate, Italy

[73] Assignee: Telettra-Telefonia Electronica e Radio, S.p.A., Italy

[21] Appl. No.: 779,586

[22] Filed: Sep. 24, 1985

Related U.S. Application Data

[63] Continuation-in-part of Ser. No. 618,567, Jun. 8, 1984, abandoned.

[30] Foreign Application Priority Data

Jun. 15, 1983 [IT] Italy ..... 21621 A/83

[51] Int. Cl.[4] ..... H01P 1/208; H01P 5/04; H01P 7/06

[52] U.S. Cl. ..... 333/212; 333/208; 333/209; 333/230; 333/231

[58] Field of Search ..... 333/208–209, 333/227, 230, 231, 232, 235, 210–212, 239, 248, 202, 24 R, 27

[56] References Cited

U.S. PATENT DOCUMENTS 4,028,651 6/1977 Leetmaa ..... 333/212

4,251,787 2/1981 Young et al. ..... 333/209

*Primary Examiner*—Marvin L. Nussbaum

*Attorney, Agent, or Firm*—Ostrolenk, Faber, Gerb & Soffen

[57] ABSTRACT

A dual mode filter has a hollow cylindrical longitudinal outer body which is divided by transversely extending disk-like separation walls into a plurality of internal cavities. At least one coupling opening in each separation wall permits coupling of energy from one cavity to another. Said coupling opening being preferably an arcuate opening, in each separation wall, which extends along a constant radius at the outer periphery of the separation wall and over a limited angular span. When the openings are two, they are spaced 180° apart, i.e. opposite one another. Adjacent separation walls are rotatably displaced 90° with respect to each other so that their respective coupling opening(s) is (are) misaligned by 90°. One respective adjustment screw is provided for each separation wall which penetrates through a hole in the outer body into one of the coupling openings in the given separation wall. Since the coupling openings are located almost against the outer body of the filter, the stroke or range of travel of the screw into the cavity is extremely limited.

13 Claims, 16 Drawing Figures

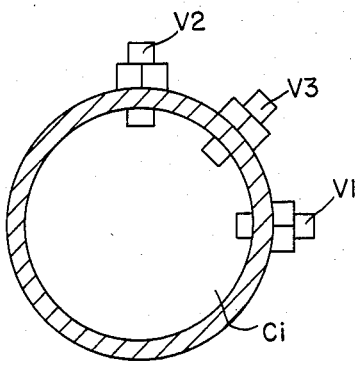
FIG.1
PRIOR ART
FIG.2
PRIOR ART
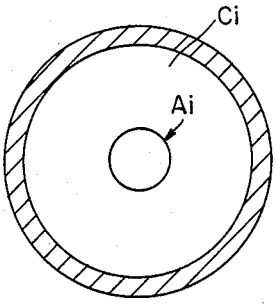
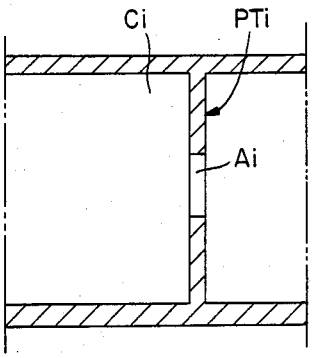
FIG.2a
PRIOR ART
FIG.3
PRIOR ART
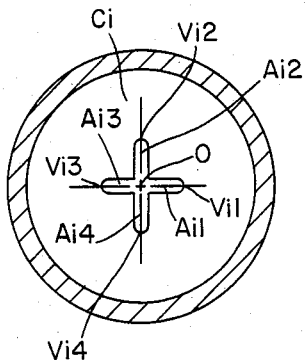
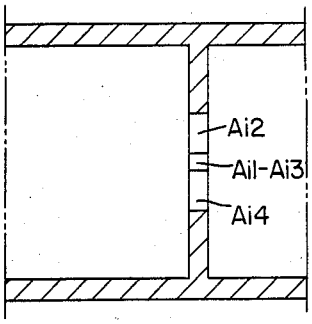
FIG.3a
PRIOR ART
FIG.4
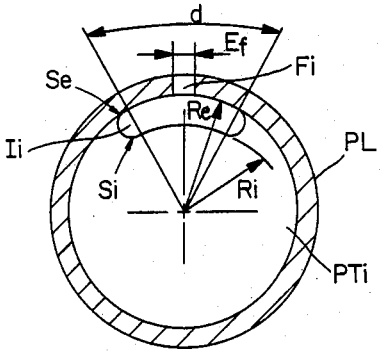
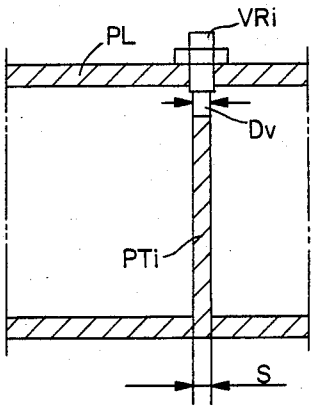
FIG.4a

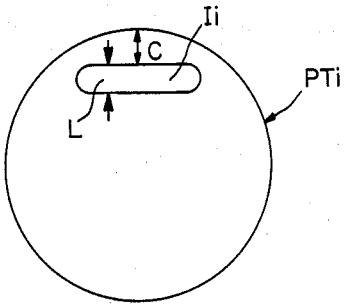
FIG.5
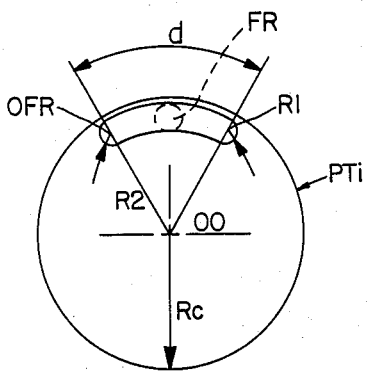
FIG.6
FIG.7
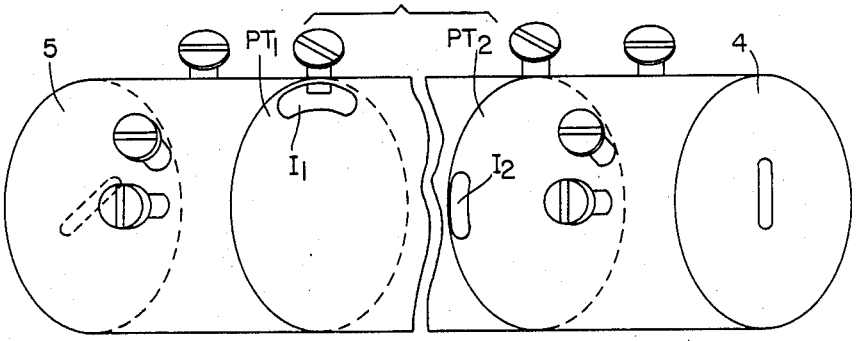
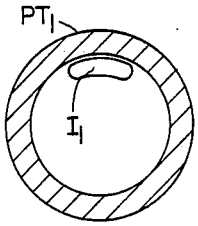
FIG.7A
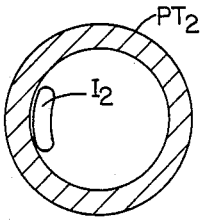
FIG.7B FIG. 7'
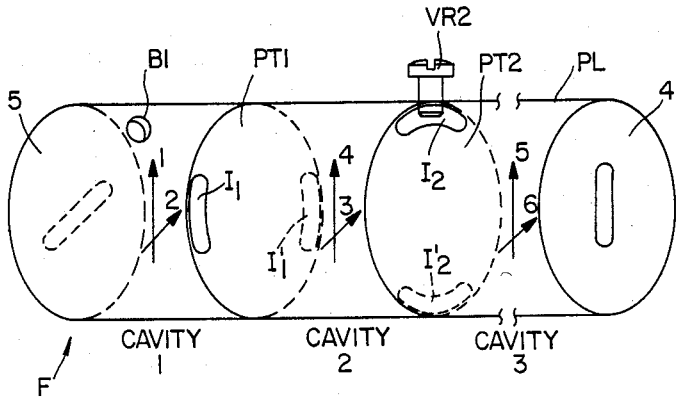
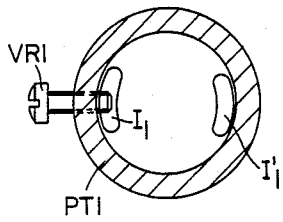
FIG. 7'A
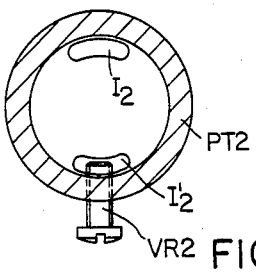
FIG. 7'B
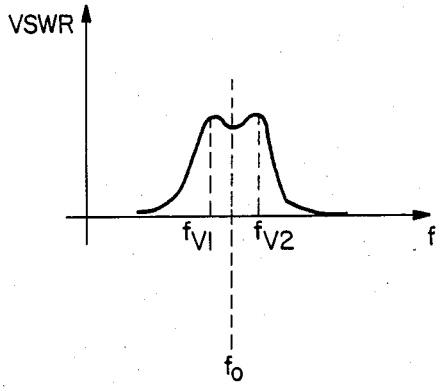
FIG. 8

DUAL MODE FILTERS

CROSS REFERENCE TO RELATED APPLICATION

This application is a continuation-in-part of Ser. No. 618,567 filed June 8, 1984, now abandoned.

BACKGROUND OF THE INVENTION

The present invention relates to a dual mode filter and, more particularly, to such a filter having a plurality of cavities, each of which is capable of supporting two orthogonal and independent resonators.

Dual mode filters of the above-mentioned type are widely known and are used because, as compared to single mode filters, they provide the advantage that they use one-half the number of mechanical cavities, while delivering substantially the same performance as single mode devices. Besides requiring one-half of the number of cavities, dual mode filters provide other advantages such a reduced size and weight and lower cost.

Of the two most common waveguide cross-section shapes are the circular shape used for realizing the $TE_{111}$ filter mode and the rectangular cross-section which is used for realizing the $TE_{101}$ filter mode.

For clearness, FIG. 1 illustrates by means of a very simplified schematic a single cavity Ci from a series of cavities C1 to Cn. From the $TE_{111}$ mode resonator in the form of the circular cavity Ci, it is possible to produce two orthogonal resonators by means of screws $V_1i$ and $V_2i$, spaced 90° from one another with respect to the outer circular periphery of the resonator, by coupling them by means of a third screw $V_3i$ which is located at a 45° angular position.

The cavities Ci are separated from each other by cross walls PTi, for example as shown in FIG. 2*a*. To couple adjacent cavities, a small opening Ai is formed in the cross wall PTi. In referring to the openings, such as opening Ai, the terms "coupling opening" or "iris" are used interchangeably. As shown in FIG. 2, the opening Ai is circular and is located in the middle of cross wall PTi. The opening Ai is shown in longitudinal cross-section in FIG. 2*a*.

In another conventional resonator, the coupling opening Ai is configured as shown in FIGS. 3 and 3*a*. The opening, sometimes referred to as an iris, comprises four radially directed openings Ai1, Ai2, Ai3, and Ai4 which extend from a center O and which are spaced 90° apart from one another. The radial openings Ai1–Ai4, have respective end boundaries which close the radial end of the opening and which are denoted by reference numerals Vi1, Vi2, Vi3, and Vi4. The ends are located a predetermined distance from the center O. Together, the four radial openings appear as a single cross shaped opening.

The irises shaped and located as described above are encumbered by many disadvantages, several of which are indicated below. A first and significant disadvantage derives from the fact that such an iris does not permit frequency based coupling adjustment. Thus, the filter which is calibrated to different frequencies can never have an equal band width at the various calibration frequencies.

A second disadvantage, growing out the shape of the iris, is that it affects and causes large variations on other filter characteristics and not only in the first frequency related parameter of the filter.

Moreover, such prior art filters also have increased insertion losses, and introduce at the final test level precalibration phases. By this it is meant that each cavity Ci, selected from one of the "n" cavities of the filter must be individually adjusted or precalibrated. And after all of the "n" cavities, identified herein as cavitites Ci to Cn have been assembled, even small disturbances or touches are sufficient to produce a response curve which is quite different from a predicted or desired theoretical curve (i.e. minimum and maximum inband matching is adversely affected).

SUMMARY OF THE INVENTION

It is an object of the present invention to provide a dual mode filter that avoids the foregoing drawbacks of such prior art filters.

It is another object of the invention to provide a filter having a plurality of longitudinally spaced cavities which are coupled to one another by means of irises which exhibit very desirable characteristics, which includes:

means for adjusting the inter cavity coupling on a frequency basis, in order to maintain the same bandwidth in the filter for different calibration frequencies while maintaining the same VSWR;

a considerable reduction of inband losses;

excellent calibration results with the VSWR ripples perfectly equalling one another in the band itself and still providing maximum matching;

The ability to calibrate the filter without the necessity of going through precalibration phases, realizing a considerable time saving during final test.

The foregoing and other objects of the present invention are realizeable with a "dual mode" filter according to the invention in which the cavities of the filter are coupled to one another through irises, of a novel construction, which are located in the inter cavity separation walls which are located at spaced intervals along the longitudinal direction of the filter. The walls divide the filter into distinct and separate cavities. Each iris penetrates through its respective separation wall and is arcuately shaped and located at the periphery of the separation wall and near the cylindrical, longitudinally extending outer wall which defines the filter. The iris is exteriorly accessible through a hole formed in the outer wall of the filter. A threaded screw extends through the hole into the iris, the penetration thereof into the iris being adjustable.

The exact configuration and dimensions of the irises, the longitudinal outer wall, the separation walls and the adjusting screw are coordinated with one another to permit the realization of filters having a maximum behavorial stability over the required frequencies.

BRIEF DESCRIPTION OF THE DRAWINGS

FIG. 1 is a cross-section through a prior art filter which provides two orthogonal resonators.

FIGS. 2 and 2*a*, respectively, illustrate a transverse and longitudinal cross-section through a prior art resonator which uses a conventional coupling opening design.

FIGS. 3 and 3*a*, respectively, illustrate a transverse and longitudinal cross-section of another prior art coupling opening configuration.

FIGS. 4 and 4A, respectively, illustrate a transverse and longitudinal cross-section of a coupling opening in accordance with a first embodiment of the invention.

FIGS. 5 and 6 illustrate in greater detail the shape and location of a coupling opening which is provided in the separation wall of a filter in accordance with the present invention.

FIGS. 7 and 7' are simplified illustrations of assembled filters and show that adjacent separation walls (shown schematically in cross-sections FIGS. 7A, 7B, 7'A and 7'B) are angularly offset.

FIG. 8 is a plot of the frequency response of the filter of the invention.

DETAILED DESCRIPTION OF THE PREFERRED EMBODIMENTS

Various aspects and advantages of the invention will now be described by reference to FIGS. 4–7 of the drawings.

Referring first to FIGS. 4 and 4*a*, iris Ii is located in the separation wall PTi, along the periphery thereof, and in proximity to the longitudinal wall PL. A hole Fi penetrates through the longitudinal wall PL and provides external access to the iris Ii. Hole Fi is located over the longitudinal center of the iris Ii and is designed to accommodate an adjusting screw VRi therein. The iris Ii of FIG. 4 is bounded by two arcuate peripheries Se and Si having respective radii Re and Ri, Re being greater than Ri.

The iris Ii is in the shape of an arcuate slot having a width L whose value is determined by the relationship Re-Ri and which extends over an arcuate angle of $\alpha$ degrees. The width Ef of the hole Fi through the longitudinal wall PL is small with respect to the angular extension of the iris Ii, but is roughly equal or in the same order of magnitude as the width L of the iris Ii.

The configuration, shape and location of the iris of FIG. 4 is preferred in view of electrical response considerations and also from mechanical considerations. Indeed, with the same eccentric position, the iris Ii location according to the invention permits it to assume cross, circular or almost rectangular configurations. The conventional shapes, cross type or circular, are however preferably avoided because of the other previously mentioned reasons.

As has been noted above, the penetration of the adjusting screw VRi into the iris Ii is adjustable, an important feature since the degree of screw penetration affects the operation of the filter. Accordingly, it should be noted that it is highly preferable to assure that the thickness of the iris Ii, which is measured as the thickness of the wall PTi, is less than the diameter Dv of the adjusting screw VRi. Also, the depth C (FIG. 5) of the threaded portion of the screw VRi will increase as the width L of the iris Ii is increased.

If C, the depth of the adjusting screw into the cavity, exceeds about a millimeter, serious problems may arise. For example, the thread of the adjusting screw VRi may not have a homogenous construction, leading to unstable electrical behavior. Moreover, it may be difficult to completely eliminate ridges during the manufacturing of the screw which ridges may also produce unstable electrical behavior.

However, applicants have reduced to practice filter devices having the iris configuration illustrated in FIGS. 4 and 6 which have overcome the foregoing problems noted with respect to prior art devices. The devices according to the invention were shown to possess improved electrical response characteristics while at the same time being mechanically simpler.

Indeed, with the unique location of the iris Ii in accordance with the present invention, the proximity of the hole Fi to the iris Ii, the depth C by which the screw penetrates into the cavity, is extremely small and on the order of a few tenths of a millimeter. Moreover, because of the iris follows the outer periphery of the separation wall PTi, it also has the cross-sectional shape of the outer wall PL and therefore it is possible to easily locate the hole Fi at the center of the iris Ii. Present technology permits the construction of separation walls PTi having a thickness on the order of 1 millimeter and screws diameters of around 4 millimeters, or well above the thickness of the iris Ii. Thus, the extreme reduction of the depth of penetration of the screw into the cavity diminishes the potential problem introduced by the screw itself and so the possibility of electrical instability is eliminated.

To construct the invention, a milling machine FR, having a dimension as shown in FIG. 6 (in a dashed circle) is employed. It was found that an iris Ii shaped according to the present invention can be realized by employing milling machines which are arranged such that their milling center OFR is at a distance R2 from the middle 00 of the cavity, providing an iris which extends over an angular arch such that $R1/\alpha$ is within the critical range of 0.210 to 0.250.

For best results, the machines are controlled to deliver mechanical tolerances within a few hundreths of millimeters. The value of the radius R2 is defined by the relationship $R2=Rc-R1-C$, where Rc corresponds generally to the size of the cavity and hence of the filter. R1 is the radius of the milling machine. Typically, for a given cavity, whose overall size is determined by Rc and in which the size of the iris is the size of the milling machine, namely R1, R2 will be greater than R1 while C, the depth of penetration of the screw in through the cavity, has the smallest value.

Although, for simplicity, it has been assumed that the width of iris Ii equals the width of the milling machine, obviously other widths are also possible.

The use of the novel iris construction and the novel location thereof as described above is expanded upon below by reference to FIGS. 7, 7A, 7B and 7', 7'A, 7'B. The FIGS. 7 and 7' illustrate generally the construction of a filter having three cavities, namely cavities 1, 2 and 3. The filter F has a generally cylindrical elongated hollow construction which is divided into the individual cavities by the transversely extending disk-like separation walls which includes end walls 4 and 5 and separation walls PT1 and PT2.

Each of the separation walls PT1 and PT2 is provided in FIG. 7' with two irises Ii and Ii' which are opposed to one another and displaced 180° along the periphery of the wall. Thus, wall PT1 includes irises $I_1$ and $I_1'$ and wall PT2 includes irises $I_2$ and $I_2'$. Further, adjacent separation walls are rotated by 90° so that their irises appear as shown in FIGS. 7', 7'A and 7'B. Finally, an adjustment screw VR2 is shown which can be adjusted to penetrate to a desired degree into the iris opening as previously noted. A similar adjusting screw will be provide for each separation wall PTi. Further, it was discovered that although two irises are provided in each separation wall, a single screw in one of the irises is sufficient for achieving the necessary control over the filter is accordance with the present invention.

FIG. 7, 7A and 7B show a filter similare to that of FIGS. 7', 7'A, 7'B but with only one opening $I_1$ resp. $I_2$ on each wall $PT_1$, $PT_2$ which are rotated by 90° from one another. In microwave transmission through radio frequency couplings, which use cavity filters of the type described above, should exhibit the following desirable characteristics. The device should provide a low insertion loss and produce narrow pass bands which be controlled from about 0.2 to 1% with respect to the center frequency $f_o$ of the filter (see FIG. 8). Further, dual mode devices, such as in the present invention, double irises are provided in each separation wall. Thus, it is necessary to provide a pass band characteristic which attenuates symmetrically with respect to the center frequency $f_o$, as shown in FIG. 8. Lastly, for optimum performance, the filter must be free of "spurious" response modes for about ±10% on either side of the center frequency $f_o$.

Applicants have discovered that a filter which uses the iris configuration and the adjustment screw location according to the present invention achieves the foregoing desirable characteristics with a relatively, very simple mechanical device. The filter provides a filter tuning capability over a very narrow frequency band which is even less than about 3% of $f_o$, without requiring mechanical modification. The filter meets each and every one of the other requirements. It has adequate ROS characteristics, an adequate frequency pass band, its output attentuates symmetrically and is free of spurious response mode, all attainable solely by operating the very short adjusting screw, for example VR2, of the present invention.

In contrast with a prior art filter wherein strong coupling between all of the cavities is present, resulting in greater insertion losses, the filter having the iris arrangement according to the invention, exhibits the following coupling characteristics. First, in the first cavity, mode 1 (vertical) is coupled with mode 2 (horizontal) through screw B1, as shown in FIG. 7' Secondly, in coupling the first cavity to the second cavity, a strong bias toward coupling modes 2 and 3 exists. The extra coupling between modes 1/4, 2/4 and 1/3 are significantly attentuated as to be negligible. Thirdly, in coupling the second cavity 2 with the third cavity 3, the strongest coupling is between modes 4 and 5, whereas couplings 3/6, 4/6 and 3/5 are highly attentuated. From the foregoing, it is evident that as the signal passes from one cavity to another, certain modes pass relatively unattentuated while the other undesirable portions of the signal are attentuated, resulting in improved insertion loss characteristics.

The foregoing would not be possible with the prior art devices, not only in consideration of the shape and location if its iris, but also because they employ a screw with a relatively longer stroke into the iris which produces instability because of inhomogeneities related to the shape of the screw and the iris.

However, the iris construction of the present invention which extends and follows the longitudinal outer wall of the filter, provides the benefit that one separation wall can be rotated with respect to the previous wall to control the coupling between the cavities. By adjusting the adjustment screw, the same filter can be tuned on different frequencies while its mechanical shape remains generally the same. Surprisingly, it was discovered that a single screw in only one of the irises of each separation wall is sufficient for achieving the objectives of the invention.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. A dual mode filter having a plurality of cavities therein, said filter comprising:

a longitudinally extending enclosure comprising an outer peripheral wall and having first and second longitudinally opposite ends;

a plurality of spaced separation walls in the enclosure which divide the interior of the enclosure into said cavities, the separation walls extending transversely to the longitudinal extension of the enclosure;

at least one respective coupling opening extending longitudinally through each separation wall, the openings coupling the cavities to one another, each of the coupling openings comprising an arcuate slot having an angular span extending along the peripheral edge of the separation wall and following the arcuate contour of the outer wall adjacent thereto;

a plurality of adjustment openings in the outer wall, each adjustment opening being located adjacent a respective one of the coupling openings, each adjustment opening providing means for communicating into the coupling opening located adjacent thereto; and a respective adjustment screw threadedly supported in each adjustment opening, the adjustment screw being adjustable to control the depth of penetration of the screw into its coupling opening to controllably block a small predetermined portion thereof.

2. The filter of claim 1, in which the adjustment openings are located such that they are centered with respect to the longitudinal extension of each respective coupling opening.

3. The filter of claims 1 or 2, in which the coupling opening is defined by first and second longitudinally extending arcuate side walls which are concentric to one another and concentric to the contour of the outer wall.

4. The filter of claim 3, in which the outer wall has a cylindrical cross-section shape and wherein the separation walls are disk shaped and extend transversely to the longitudinal dimension of the filter.

5. The filter of claim 4, in which the coupling opening extends over an arc angle of $\alpha°$ with respect to a radial center of the separation wall and in which the ratio between the thickness of the coupling opening, which is measured as the distance between its first and second concentric side walls, and the angle $\alpha$, is in the range between 0.210 and 0.250.

6. The filter of claim 5, in which each of said separation walls comprises another coupling opening therein which has the shape of said coupling opening except that said another coupling opening is located symmetrically opposite to said coupling opening with respect to said radial center.

7. The filter of claim 6, comprising third and fourth longitudinally extending arcuate side walls which define said another coupling opening, said third and fourth longitudinally extending arcuate side walls having continuous surfaces so that said another coupling opening is inaccessible by an adjustment screw.

8. The filter of claim 5, in which adjacent ones of said separation walls are angularly rotated from each other, the walls being rotated such that the coupling opening of adjacent separation walls are displaced by about 90° from one another.

9. The filter of claim 3, in which each of said separation walls comprises another coupling opening therein which has the shape of said coupling opening except that said another coupling opening is located symmetrically opposite to said coupling opening.

10. The filter of claim 9, comprising third and fourth longitudinally extending arcuate side walls which define said another coupling opening, said third and fourth longitudinally extending arcuate side walls having continuous surfaces as that said another coupling opening is inaccessible by an adjustment screw.

11. The filter of claim 9, in which adjacent ones of said separation walls are angularly rotated from each other, the walls being rotated such that the pairs of coupling openings of adjacent separation walls are displaced by about 90° from one another.

12. The filter of claim 3, in which adjacent ones of said separation walls are angularly rotated from each other, the walls being rotated such that the coupling opening of adjacent separation walls are displaced by about 90° from one another.

13. The filter of claim 1, in which adjacent ones of said separation walls are angularly rotated from each other, the walls being rotated such that the coupling opening of adjacent separation walls are displaced by about 90° from one another.

* * * * *